United States Patent [19]

Eichler

[11] 4,084,537

[45] Apr. 18, 1978

[54] FLANK DRIVE FOR PLANING HULL AND DISPLACEMENT CRAFT

[76] Inventor: Horst Eichler, Aufdem Sande 12, 54 Koblenz, Germany

[21] Appl. No.: 733,146

[22] Filed: Oct. 18, 1976

Related U.S. Application Data

[63] Continuation of Ser. No. 549,558, Mar. 17, 1975, abandoned.

[51] Int. Cl.[2] ..... B63H 1/10

[52] U.S. Cl. ..... 115/50; 416/108

[58] Field of Search ..... 114/147, 148; 115/49-54; 416/108-111

[56] References Cited

U.S. PATENT DOCUMENTS

| | | | |
|---|---|---|---|
| 1,922,606 | 8/1933 | Voith | 115/50 |
| 2,589,300 | 3/1952 | Sherman | 115/50 |
| 3,134,443 | 5/1964 | Snow | 115/50 |
| 3,442,242 | 5/1969 | Laskey et al. | 114/148 |
| 3,759,211 | 9/1973 | Kuntz, Jr. | 114/148 |

FOREIGN PATENT DOCUMENTS

| | | | |
|---|---|---|---|
| 358,235 | 4/1938 | Italy | 115/50 |
| 81,162 | 7/1951 | Netherlands | 115/50 |
| 1,072,124 | 6/1967 | United Kingdom | 114/148 |

*Primary Examiner*—George E. A. Halvosa
*Assistant Examiner*—Stuart M. Goldstein
*Attorney, Agent, or Firm*—Beall & Jeffery

[57] ABSTRACT

The invention relates to a flank drive for propelling a boat wherein a plurality of propeller housings are rotatably mounted in a wheel body about and in driving engagement with a normally stationary guide wheel centrally of the wheel body, which wheel body is rotated about its own central axis by means of a propulsion motor to carry the housings about the wheel body axis and rotate the housings about their own axes, so that the propeller housings undergo epicyclic motion.

The propeller blade in each propeller housing can be adjusted relative to its housing passively by relative motion between abuttments or positively by means of an automatic hydraulic control to the most effective angle of attack, whereby the blades mainly exert flank force to the surrounding water. The guide wheel may be swivelled to steer the boat.

13 Claims, 7 Drawing Figures

FIG. 1A
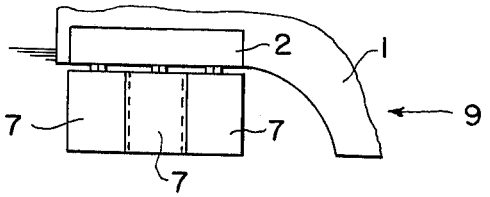
FIG. 1B
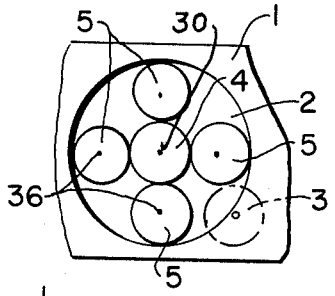
FIG. 1C
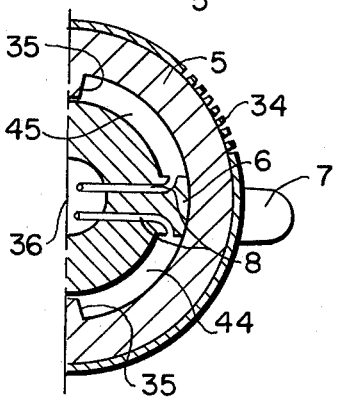
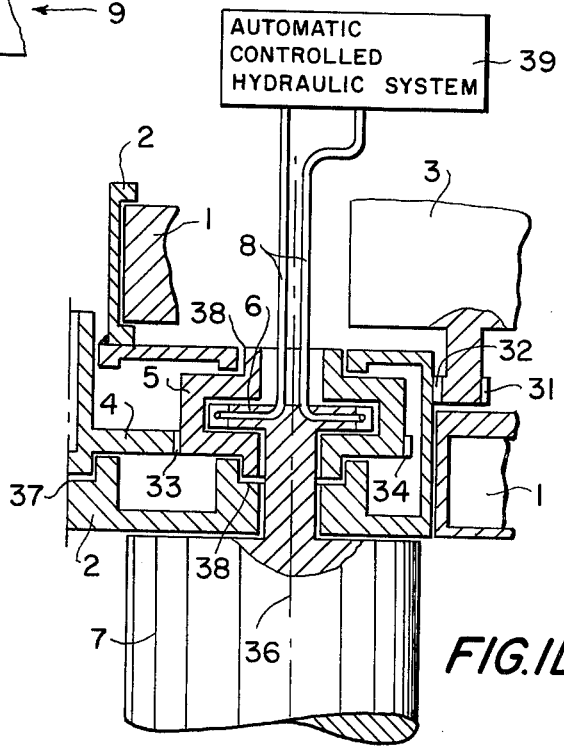
FIG. 1D
FIG. 2A
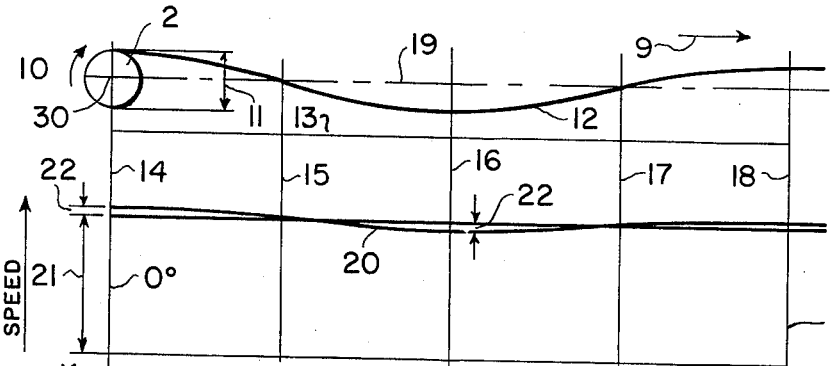
FIG. 2B
FIG. 2C
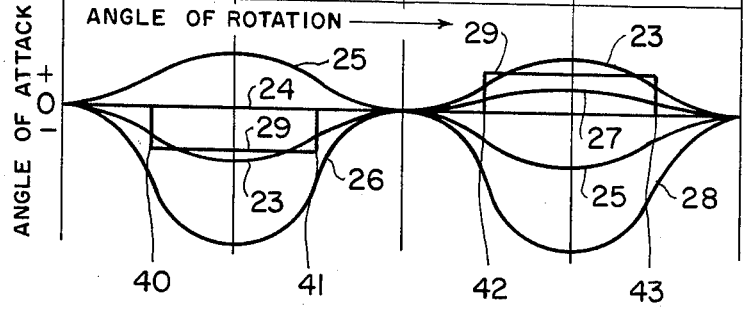

FLANK DRIVE FOR PLANING HULL AND DISPLACEMENT CRAFT

This is a continuation of application Ser. No. 549,558 filed Mar. 17, 1975 and now abandoned.

BACKGROUND OF THE INVENTION

The present invention relates as indicated to a flank drive for planing hull and displacement craft, which drive includes a wheel body mounted in the craft or boat for driven rotation about a vertical axis. A plurality of propeller housings are rotatably disposed within the wheel body. The propeller blades are adjustable and move through the water in sinuating lines at each revolution of the wheel body. As a result, the propeller blades exert mainly flank forces, that is, forces transverse to the direction of the boat, to the surrounding water.

Screws are well known as a means for propelling planing hull craft and high speed displacement crafts, but have proved disadvantageous due to their decreasing efficiency at high boat speeds and the high propeller r.p.m. incident thereto.

The buoyancy principal of ship screws as well as that of conventional vane-screw propellers having a high circumferential speed in relation to the boat speed results in a high unit load on each propeller blade, and in heavy turbulent water, this results in a considerable loss of propulsion. This is in marked contrast with the present invention which employs a flank drive wherein more water is seized athwartships with increasing boat speed thereby resulting in a low acceleration of the water.

SUMMARY OF THE INVENTION

The flank drive of the present invention can be used either in a single or multiple arrangement and is preferably installed in the front of the craft where it would work in the undisturbed upstream water and not in the decellerated water and the boat rear. Arranging the flank drive in the dead water of another drive is also possible and significant advantages would be derived from such arrangement.

The flank drive design of the present invention is based on the general vane-screw propeller having a wheel body rotatably inserted into the well of the boat bottom, with propeller blades being eccentrically pivoted relative to the wheel body axis. Even under full load all propeller blades of the flank drives are singly pivoted in rotatable swiveling devices which, in turn, are backed by a restoring drive such that the swiveling devices do not rotate about their axes in relation to the boat.

For steering the boat, the flank drive can be rotated about the wheel body axis by means of an adjustable restoring drive.

A simplified flank drive having a lower efficiency can also be obtained by means of underbalanced propeller blades. In this case of passive swiveling devices, the surfaces behind the swiveling axes of the propeller blades are greater than those in front of the axes whereby the propeller blades move ineffectively along their sinuating lines in the upstream giving no propulsion until the swiveling motion is stopped at the most effective angle of attach between the propeller blades and their sinuating lines.

A more efficient flank drive is obtained by means of automatically controlled swiveling devices which are similar to the common reversible propeller systems for rudder and anti-roll devices. In this arrangement, the propeller blades are continuously positively pitched to the most effective angle of attack.

If the automatic control of the swiveling devices reverses the most effective angle of attack of the propeller blades such that the blades are pitched to starboard instead of to port during their motions transverse to the direction of travel of the boat, the boat will stop or reverse its heading.

The automatic control permits the propeller blades to be adjusted to different angles of attack, for example a larger starboard angle than port angle, even during their motion transverse to the boat heading. This arrangement generates different flank forces to both sides transverse to the boat heading thereby changing the course of the boat. Such change of course can be intensified by simultaneously pitching all propeller blades to only one side.

BRIEF DESCRIPTION OF THE DRAWINGS

In the application drawings,

FIG. 1A is a fragmentary side elevational view of part of the boat, showing the wheel body mounted therein;

FIG. 1B is a fragmentary top plan view of the boat, more clearly showing the guidewheel and reversible propeller housings;

FIG. 1C is an enlarged, sectional view through a part of the propeller housing;

FIG. 1D is an enlarged, partially fragmented and sectioned view showing in more detail the construction of the propeller housings and the manner in which the drive is carried by the boat, and FIGS. 2A, 2B, and 2C are diagrammatic representations of the operation of the flank drive, showing the movement diagrams of a propeller blade.

DETAILED DESCRIPTION OF THE PREFFERED EMBODIMENTS

Referring now in detail to the application drawing, wherein like parts are indicated by like reference numerals, the flank drive constructed in accordance with the present invention includes a wheel body 2 mounted in the end of a boat shown fragmentarily at 1. The body 2 is rotated about its central vertical axis 30 by means of a propulsion motor 3, shown in dashed lines in FIG. 1B and having gear 31 drivingly engaging the driven gear teeth 32 of the wheel body 2. A guide wheel 4 is centrally mounted at 37 for pivotal movement in the mounting 37 of the wheel body 2, with the periphery of the wheel 4 being formed with teeth 33 engaging with teeth 34 formed in the periphery of each of the propeller housings 5, as can be seen in FIG. 1D. The number of teeth 33 on guide wheel 4 is the same as the number of teeth 34 in each housing 5. As seen in FIG. 1B, the propeller housings 5 are eccentrically mounted relative to the axis 30 for rotary movement in the wheel body 2 by mountings 38. If the position of the wheel guide 4 is not changed with respect to the course 9 of the boat, the reversible propeller housings 5 are controlled by the guide wheel 4 so that the propeller housings 5 do not rotate about their own vertical axes 36 with respect to each position of the wheel body. By rotatably adjusting the guide wheel 4 about axis 30 by adjustment means which are not shown, the direction of all the reversible propeller housings 5 is changed with respect to each position of the wheel body, for steering and stopping.

Each propeller housing 5 contains reversible vanes 6 integral with its propeller blade 7, with the vanes 6 being pivoted in the propeller housings 5 between abutments 35. By means of an automatic controlled hydraulic system 39, which communicates with hydraulic lines 8, which in turn communicate respectively with opposite sides of vanes 6 to the respective chambers 44, 45, hydraulic fluid can be supplied to the appropriate side or chamber of the reversing vanes 6 to permit the propeller blades 7 to be swiveled about their axis 36 to the most effective angle of attack.

FIG. 2 illustrates the operation of the flank drive of the present invention by means of a movement diagram of a propeller blade 7. In FIG. 2, the course of the boat, represented by the arrow indicated at 9, is from left to right in this figure, and the wheel body 2 turns clockwise, as represented by the arrow 10. The amplitude 11 of the sinuating line described by the propeller blade swivel axis 36 equals twice the eccentricity of the swiveling axis 36 relative to the axis 30 of the wheel body 2. The line 13 represents a time period corresponding to a 360° rotation of the wheel body 2, which lasts from position 14 to position 18.

At position 14: the propeller blade 7 is at port directly abeam of the axis 30 of the wheel body 2; the sinuating line 12 of the swivel axis 36 of the propeller blade 7 runs parallel to the travel line of the axis 30 of the wheel body 2, which line is represented at 19; the propeller blade speed is represented at 20 and in the direction of the boat heading 9 is the total of the boat speed 21 and the forward component of the circumferential speed 22 of the propeller blade about the axis 30 of the wheel body 2; the attack angle curve between the propeller blade and sinuating line 12 is represented by line 23 which intersects the zero angle axis represented at 24.

At position 15: the propeller blade 7 is forward of the wheel body 30 in the direction 9 of the boat heading; the sinuating line 12 of the propeller blade turns from a clockwise to a counter clockwise rotation; the propeller blade speed 20 in the direction of the boat heading 9 corresponds to the boat speed 21; the attack angle 23 of the propeller blade is fully pitched to starboard.

At position 16: the propeller blade 7 is at starboard directly abeam of the axis 30 of the wheel body 2; its sinuating line 12 runs parallel to the travel 19 of the wheel body 2, and the propeller blade speed 20 in the direction of the boat heading is the difference between boat speed 21 and circumferential speed 22 of the propeller blade about the axis 30 of the wheel body 2; the attack angle curve 23 between the propeller blade 7 and its sinuating line 12 intersects the zero axis 24.

At position 17: the propeller blade 7 is directly behind the axis 30 of the wheel body 2; its sinuating line 12 turns from counter clockwise to a clockwise rotation, and the propeller blade speed 20 in the direction of the boat heading 9 corresponds to the boat speed 21; the attack angle 23 of the blade is fully pitched to port.

The functions at position 18 are the same as those at position 14 and need not be described again.

If the attack angle curve 23 is symmetrically turned about the zero axis 24, as represented by curve 25, the boat 1 will stop or reverse its heading 9. If the curves of the attack angles 23 and 25 are increased below the zero axis 24, as represented by curve 26, and/or are decreased above the zero axis 24, as represented by a curve 27, or drawn beyond the zero axis, as represented by curve 28, that is, changed to be unsymmetrical with respect to zero line 24 from positions 14 to 18 so that the flank drive causes a change in the heading of the boat. According to curves 26, 27 and 28, the boat 1 would change its course to port during ahead run and with a flank drive installed at the rear of the boat. The curves 23-28 are attained by the automatic controlled hydraulic system 39 changing the angle of attack of propeller blade 7.

Line 29 of FIG. 2C shows the use of passive swiveling devices containing freely moving propeller blades 7 within the housing 5, as shown, that is without the automatic controlled hydraulic system. These underbalanced blades will be pitched to the zero axis until the reversible propellers impact on the end position stops or abuttments 35 at positions 40 and 42. These angles of attack corresponding to vane 6 engaging an abuttment 35 remain constant from position 40 to position 41 and from position 42 to position 43 until the upstream fluid pressure causes the propeller blades to detach from the end position abuttments 35 again and return to a zero angle of attack at 41 and 43, as represented by lines 29 in FIG. 2. From position 14 to position 40, from position 41 to position 42, and from position 43 to position 18, the angle of attack will be zero.

I claim:

1. A flank drive for a watercraft, comprising: a wheel body mounted for rotation about an axis in said watercraft; propulsion means for rotating said wheel body about its axis; a plurality of propeller housings mounted on said wheel body in peripherally spaced relationship around said wheel body axis for rotation with said wheel body about said wheel body axis when said wheel body is driven by said propulsion means, and each of said propeller housings being rotatably mounted with respect to said wheel body about respective propeller housing axes so that each propeller housing axis follows a stationary sinuating line as the watercraft moves rectilinarilly through the water with rotation of said wheel body; normally stationary reaction means drivingly coupled with said propeller housings so that said propeller housings undergo epicyclic motion when said wheel body is driven by said propulsion means; a propeller drivingly carried by each of said propeller housings, respectively, to extend from said watercraft into the water during movement of said watercraft through the water; each of said propellers being mounted for limited pivotal movement relative to its housing; angle of attack control means for controlling the pivoting of each of said propellers relative to its propeller housing for positioning each propeller blade at an effective angle of attack relative to said sinuating line, over at least a major portion of said sinuating line, so as to exert forces on the surrounding water transverse to the driving direction of said watercraft for propulsion of the watercraft.

2. The flank drive of claim 1, wherein said normally stationary reaction means is mounted for selective relative movement with respect to said watercraft and said wheel body so as to correspondingly change the position of each propeller housing relative to said wheel body at each position of said wheel body for steering the watercraft by correspondingly changing the values of the angle of attack of the propellers on the starboard side unsymmetrically with respect to values of the angle of attack of the propellers in corresponding positions on the port side of the watercraft.

3. The flank drive of claim 2, wherein said normally stationary reaction means is a guide wheel mounted for pivotal movement about said wheel body axis relative to said wheel body and relative to said watercraft, and having a peripheral array of gear teeth concentric with said wheel body axis; and each of said propeller housings having a peripheral array of gear teeth, equal in number with and in interengagement with the gear teeth of said guide wheel.

4. The flank drive of claim 1, wherein said angle of attack control means comprises a hydraulic motor drivingly connected between each propeller housing and its propeller for positively controlled pivoting of each propeller relative to its propeller housing to the most effective angle of attack of said blades according to the supply and exhaust of hydraulic fluid to the hydraulic motors, with said relative pivotal movement between each propeller and its propeller housing being continuously varied so as to change the angle of attack for each propeller, in order and during rectilinear propulsion from zero at a position immediately to port of the wheel body axis, to a maximum angle of attack forward of the wheel body axis, to a zero angle of attack starboard of the wheel body axis, to a maximum angle of attack astern of the wheel body axis and to a zero angle of attack to the port of the wheel body axis with smooth transitions, and said forward maximum angle of attack equal to and opposite from the astern maximum angle of attack for each complete revolution of said wheel body.

5. The flank drive of claim 4, including steering means for changing said forward and astern maximum angles of attack relative to each other while maintaining zero angles of attack at the port and starboard positions of said propellers.

6. The flank drive of claim 1, wherein said angle of attack control means comprises positive abuttments limiting the pivotal movement of each propeller relative to its housing and including an unbalanced hydrodynamic configuration of each propeller relative to its axis of rotation with respect to its propeller housing such that each propeller presents a smaller hydrofoil surface forward of its axis than it does present rearward of its axis; each propeller being mounted for free relative rotation with respect to its propeller housing between said abuttments solely as determined by the unbalanced hydrodynamic forces on said propellers so that angle of attack control means changes the angle of attack of each propeller, in order and during rectilinear propulsion, from zero at a position immediately to port of the wheel body axis to a position between said port and forward of said wheel body axis where the unbalanced hydrodynamic forces pivot said propeller relative to its propeller housing to engage one of said abuttments at a maximum angle of attack, which maximum angle of attack is maintained past said position forward of said wheel body axis to a position between said forward position and a position to the starboard of said wheel body axis wherein said propeller abruptly returns to its zero angle of attack, which zero angle of attack is maintained through said starboard position to a position between said starboard position and a position to the stern of said wheel body axis where the hydrodynamic forces will be unbalanced in the opposite direction to pivot said propeller fully over and engage the opposite one of said abuttments at a maximum angle of attack opposite to said first mentioned maximum angle of attack, which maximum opposite angle of attack is maintained until the hydrodynamic forces are balanced to return said propeller to a zero angle of attack between said astern position and said port position.

7. The flank drive of claim 1, wherein all of said axes are generally vertical and parallel to each other, and said axis of rotation of each propeller housing relative to said wheel body coincides with its axis of rotation relative to its propeller.

8. The flank drive of claim 1, wherein said normally stationary reaction means and said propeller housings are intergeared with an equal number of teeth on each so that with each revolution of said wheel body, said propeller housings will complete one revolution about their axis of rotation relative to said wheel body.

9. The flank drive of claim 1, wherein said angle of attack control means comprises power means drivingly connected between each propeller housing and its propeller for positively controlling pivoting of each propeller relative to its propeller housing to the most effective angle of attack of said blades, with said relative pivotal movement between each propeller and its propeller housing being continuously varied so as to change the angle of attack of each propeller, in order and during rectilinear propulsion, from zero at a position immediately to port of the wheel body axis, to a maximum angle of attack forward of the wheel body axis, to a zero angle of attack starboard of the wheel body axis, to a maximum angle to attack astern of the wheel body axis, and to a zero angle of attack to the port of the wheel body axis with smooth transitions and said forward maximum angle of attack equal to and opposite from the astern maximum angle of attack, for each complete revolution of said wheel body.

10. The flank drive of claim 9, including steering means for changing said forward and astern maximum angles of attack relative to each other while maintaining zero angles of attack to the port and starboard positions of said propellers.

11. A flank drive for a watercraft, comprising: a wheel body mounted for rotation about a generally vertical axis in said watercraft; propulsion means for rotating said wheel body about its axis; a plurality of propeller housings mounted on said wheel body in peripherally spaced relationship around said wheel body axis for rotation with said wheel body about said wheel body axis when said wheel body is driven by said propulsion means so that each propeller housing axis follows a stationary sinuating line as the watercraft moves rectilinearilly through the water; a propeller drivingly carried by each of said propeller housings, respectively, to extend from said watercraft into the water during movement of said watercraft through the water; each of said propellers being mounted for limited pivotal movement relative to said wheel body; angle of attack control means for controlling the pivoting of each of said propellers relative to said wheel body for positioning each propeller blade at an effective angle of attack relative to said sinuating line, to change the angle of attack for each propeller, in order and during rectilinear propulsion, from zero at a position immediately to port of the wheel body axis, to a maximum angle of attack forward of the wheel body axis, to a zero angle of attack starboard of the wheel body axis, to a maximum angle of attack astern of the wheel body axis and to a zero angle of attack to the port of the sheel body axis, and said forward maximum angle of attack is equal to and opposite from the astern maximum angle of attack, for each complete revolution of said wheel body whereby said wheel body is driven to produce a tangential speed for each propeller substantially less than the speed of the watercraft to produce a net forward propulsion.

12. The flank drive of claim 11, including steering means for changing said forward and astern maximum angles of attack relative to each other while maintaining zero angles of attack at the port and starboard positions of said propellers.

13. The flank drive of claim 11, wherein said angle of attack control means includes a free pivotal mounting of each propeller relative to its housing between positive abuttments, and each propeller having a hydrofoil surface forward of its axis of pivoting that is greater than and unbalanced with respect to its hydrofoil surface rearward of its pivoting angle so that the angle of attack control means changes the angle of attack of each propeller, in order and during rectilinear propulsion, from zero at a position immediately to port of the wheel body axis to a position between said port and forward of said wheel body axis where the unbalanced hydrodynamic forces pivot said propeller relative to said wheel body to engage one of said abuttments at a maximum angle of attack, which maximum angle of attack is maintained past said position forward of said wheel body axis to a position between said forward position and a position to the starboard of said wheel body axis wherein said propeller abruptly returns to its zero angle of attack, which zero angle of attack is maintained through said starboard position to a position between said starboard position and a position to the stern of said wheel body axis where the hydrodynamic forces will be unbalanced in the opposite direction to pivot said propeller fully over and engage the opposite one of said abuttments at a maximum angle of attack opposite to said first mentioned maximum angle of attack, which maximum opposite angle of attack is maintained until the hydrodynamic forces are balanced to return said propeller to a zero angle of attack between said astern position and said port position.

* * * * *